United States Patent [19]

Hess, Jr. et al.

[11] Patent Number: 4,885,593

[45] Date of Patent: Dec. 5, 1989

[54] FEEDS FOR COMPACT RANGES

[75] Inventors: Doren W. Hess, Jr., Norcross; John R. Jones, Lawrenceville, both of Ga.

[73] Assignee: Scientific-Atlanta, Inc., Atlanta, Ga.

[21] Appl. No.: 908,996

[22] Filed: Sep. 18, 1986

[51] Int. Cl.[4] ..... H01Q 13/00

[52] U.S. Cl. ..... 343/786; 343/703; 343/781 R

[58] Field of Search ..... 343/786, 781 R, 703, 343/781 P, 840; 333/239

[56] References Cited

U.S. PATENT DOCUMENTS

| | | | |
|---|---|---|---|
| 2,546,840 | 3/1951 | Tyrrell | 333/21 |
| 2,853,682 | 9/1958 | Epstein | 333/21 |
| 2,891,224 | 6/1959 | Fox | 333/248 |
| 2,930,040 | 3/1960 | Weil | 343/756 |
| 3,031,661 | 4/1962 | Moeller et al. | 343/786 |
| 3,065,373 | 11/1962 | Robertson | 333/157 |
| 3,302,205 | 1/1967 | Johnson | 343/703 |
| 3,380,057 | 4/1968 | Osborn | 343/786 |
| 3,434,146 | 3/1969 | Petrich | 343/783 |
| 3,458,862 | 7/1969 | Franks | 343/786 |
| 3,560,976 | 2/1971 | Foldes | 343/783 |
| 3,611,396 | 10/1971 | Jones | 343/776 |
| 3,662,393 | 5/1972 | Cohn | 343/786 |
| 3,755,760 | 8/1973 | Ohm | 333/183 |
| 3,758,882 | 9/1973 | Morz | 333/21 A |
| 4,021,814 | 5/1977 | Kerr et al. | 343/786 |
| 4,100,514 | 7/1978 | DiTullio et al. | 333/21 A |
| 4,163,961 | 8/1979 | Woodward | 333/261 |
| 4,168,504 | 9/1979 | Davis | 343/786 |
| 4,352,077 | 9/1982 | Gerlack | 333/252 |
| 4,414,516 | 11/1983 | Howard | 333/21 A |
| 4,447,811 | 5/1984 | Hamid | 343/783 |
| 4,468,672 | 8/1984 | Dragone | 343/783 |
| 4,544,900 | 10/1985 | Howard | 333/21 A |
| 4,554,552 | 11/1985 | Alford et al. | 343/786 |
| 4,578,681 | 3/1986 | Howard | 343/786 |

OTHER PUBLICATIONS

Johnson et al., "Compact Range . . . Measurements", IEEE Trans. on Ant. and Prop., vol. AP-17, Sep. 1969, pp. 568-576.

Collins, Foundations for Microwave Engineering, ch. 3, pp. 64-143, 1966.

Kraus, Antennas, ch. 12, 1950, pp. 347-350.

Antenna Engineering Handbook, edited by Johnson and Jasik, McGraw-Hill, New York, NY, second edition, 1984, pp. 40-4, 40-5.

Burnside et al., "Blended Surface Concept for Compact Range Refl.", Pi Proc. of Annual Meeting of Ant Measurement Tech. Assoc., Melbourne, FL, pp. 10-1 to 10-10, 29-31, Oct. 1985.

Cooke et al., "Design, Fabr., and Test of S-Band Telemetry Ant. System", Final Tech. Report, Project A-3028, *GA Tech Research Inst.* 1982, pp. 10-27 and 53-58.

Chen et al., "Model Char. of Quadrulple-Ridged Circ. and Square Waveguides", IEEE *Trans. on Microwave Theory and Tech.*, vol. MTT-22, Aug. 1974, pp. 801-804.

Johnson et al., "Determination of Far-Field . . . Measurements", Proc. of IEEE, vol. 61, pp. 1668-1694, Dec. 1973.

Harrison, "A New Approach to Radar Cross-Section Compact Range", Microwave Journal, vol. 29, No. 6, pp. 137-145, Jun. 1986.

Johnson, "Some Design Parameters for Point-Source Compact Ranges", IEEE Trans. on Antennas and Prop., vol. AP-33, No. 6, Jun. 1986, pp. 845-847.

Heedy et al., "An Aperture-Matched Compact Range Feed Horn Design", IEEE Trans. on Ant. and Prop., vol. AP-33, No. 11, Nov. 1985, pp. 1249-1255.

Burnside et al., "Target Illum. Req'ts for Low RCS Target Measurements", Proc. of An. Meeting of Antenna Measurement Tech. Assoc., Melborne, FL 29-31 Oct. 1985, pp. 23-1 to 23-9.

*Primary Examiner*—Rolf Hille

*Assistant Examiner*—Michael C. Wimer

*Attorney, Agent, or Firm*—Kilpatrick & Cody

[57] ABSTRACT

Circular open ended waveguide feeds for compact ranges. Feeds according to the present invention employ smaller apertures for a given frequency of operation than a standard compact range feed. According to a first embodiment of the invention, a circular open ended waveguide feed is constructed to operate with its lowest desired frequency of operation at approximately 1.01 times the cutoff frequency. A second embodiment includes a circular open-ended waveguide loaded with ridges to lower the cutoff frequency further and thus further reduce aperture size for a given bandwidth to radiate a broader beamwidth.

8 Claims, 4 Drawing Sheets

FEEDS FOR COMPACT RANGES

This invention relates to compact range feeds.

BACKGROUND OF THE INVENTION

Compact ranges are used to illuminate test objects with a planar electromagnetic wave front in a minimum of space. Such ranges typically may be contained within an anechoic chamber or a room lined with absorber and thus eliminate sources of stray reflections found in outdoor ranges. In addition, the operation of such indoor ranges is not affected by the weather. Additional advantages include increased security resulting from conducting measurements of sensitive test objects indoors rather than outdoors and efficiencies achieved in instrumenting, setting up and adjusting the illuminating antenna and the test object in near-field conditions rather than requiring range operators to make numerous trips between the transmit site and the test site over the far-field distance typically required in outdoor ranges.

Compact ranges typically utilize a feed positioned at the focal point of a paraboloidal reflector to allow the reflector to reflect the spherical wave radiated by the feed as a planar wave. Such compact ranges are disclosed in U.S. Pat. No. 3,302,205 issued Jan. 31, 1967 to R. C. Johnson, which patent is incorporated herein by reference. Other secondary reflectors may also be used in addition to the paraboloidal reflector.

The Johnson patent shows the use of only a small portion of the range reflector to produce a planar wave in order to avoid aberrations caused by surface and edge currents. More recent techniques, however, allow a larger portion of the range reflector to be utilized. Such techniques include rolling, blending, and serrating the edges of the reflector. Nevertheless, the "quiet zone", which is the region of space on the range in which a uniform plane wave is produced, is limited to a cross section whose size is small relative to the total reflector area. For instance, a typical quiet zone may be six feet by four feet in cross-section for a ten foot radius reflector, or twenty-four square feet for a greater than three hundred square foot reflector.

Compact ranges, including offset paraboloidal reflector based compact ranges, also suffer from amplitude taper in the quiet zone field. This amplitude taper is caused by (1) differential space loss or spreading loss from the feed to different points on the reflector and (2) the amplitude roll-off of the feed pattern. Although this taper is an inherent feature of compact ranges, optimized feed designs can minimize it.

SUMMARY OF THE INVENTION

The present invention provides compact range feeds which minimize amplitude taper and increase the cross-sectional area of the quiet zone volume. The aperture size of such feeds is smaller than that customarily used for a particular bandwidth so that a broader beamed pattern may be radiated. According to one aspect of the invention, a circular open ended waveguide is operated so that its lowest frequency of operation is very near its cutoff frequency, at between 0.8 and 3 percent above cutoff, and preferably at approximately one percent above cutoff, to illuminate the compact range. The highest frequency of operation is approximately 23% above the cutoff frequency. Such a feed exhibits the maximum possible beamwidth for an open ended empty round waveguide feed at its lowest frequency of operation and over its bandwidth, and it therefore produces the largest test volume possible with such a feed for that bandwidth. According to a second aspect of the invention, a circular open ended round waveguide is loaded with axial ridges oriented parallel to the E-plane of the propagated wave to allow the waveguide to be made smaller than the smallest possible empty round waveguide for a given bandwidth. Two pairs of such ridges, oriented orthogonally to each other, may be used in waveguide feeds used to radiate orthogonally polarized energy in a broader radiation pattern.

It is therefore an object of the present invention to provide compact range feeds which reduce amplitude taper of the radiated pattern and which allow increased volume of the range quiet zone.

It is an additional object of the present invention to provide circular open ended compact range feeds which have smaller aperture size than previous compact range feeds and thus which radiate patterns with broader beamwidths.

It is an additional object of the present invention to provide compact range feeds which are operated very near their cutoff frequencies to reduce the required aperture size.

It is an additional object of the present invention to provide compact range feeds which are loaded with axial ridges to reduce the cutoff frequency and thereby reduce the required aperture size.

Other objects, features and advantages of the present invention will be apparent with reference to the remainder of this document.

DETAILED DESCRIPTION OF THE DRAWINGS

Figure 1:
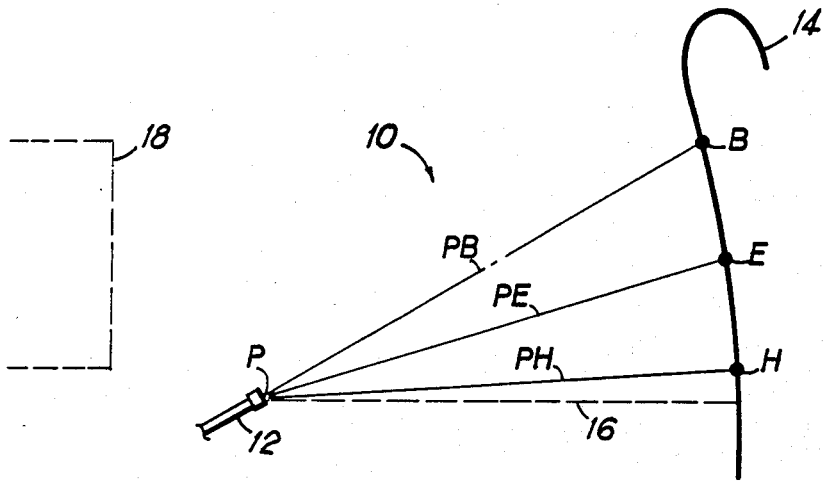
FIG. 1 is a schematic vertical cross-sectional view of a prime focus fed paraboloidal reflector compact range on which feeds of the present invention may be used.
Figure 2:
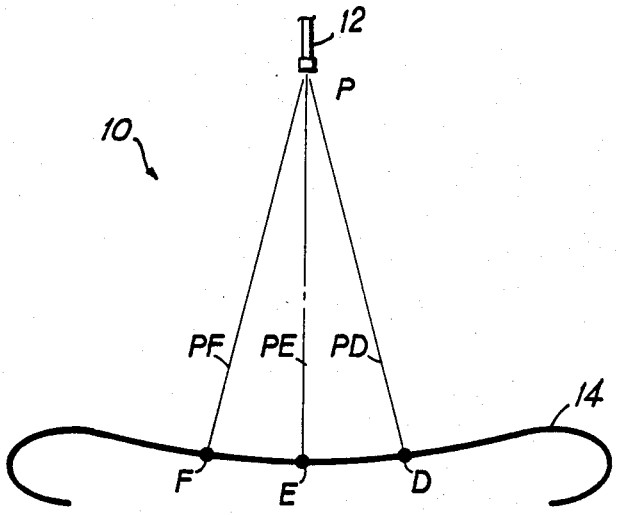
FIG. 2 is a schematic horizontal cross-sectional view of the compact range of FIG. 1.

FIGS. 1 and 2 are schematic illustrations of a prime focus-fed paraboloidal reflector compact range on which feeds according to the present invention may be used. The principles of this invention apply to other types of compact ranges as well, but the simple and flexible optics of the prime focus-fed paraboloidal reflector compact range lend themselves to this description of the invention. Range 10 includes a feed 12 and a reflector 14. Reflector 14 in the illustrated version of range 10 is a semicircular paraboloidal section corresponding to the Scientific-Atlanta Model 5753 compact range reflector with a fifteen foot radius and a five foot blended rolled edge treatment. The focal length 16 for this reflector is twenty-four feet. The reflector is commercially available. Other reflectors may be used as well.

The optics of range 10 illustrate sources of amplitude taper in the quiet zone field 18. Reflector 14 is constructed such that the total length of each incident and corresponding reflected ray from the feed to the quiet zone is constant. This property of reflector 14 allows quiet zone 18 to be illuminated by a collimated planar wave front. The length of incident rays from the feed 12 to the reflector 14 varies, as does the length of their corresponding reflected rays. FIG. 1, for instance, shows schematically that the distance PB from feed 12 to the point labeled B on reflector 14, from which the reflected ray illuminates the top of the quiet zone, is greater than the distance PE from feed 12 to the point labeled E on reflector 14, from which the reflected ray illuminates the center of quiet zone 18. Similarly, the distance PH from feed 12 to point H on reflector 14, from which the reflected ray illuminates the bottom of quiet zone 18, is less than the distance PE from feed 12 to point E.

Because each incident ray illuminating reflector 14 is of different length than other such rays, the energy propagated along that ray will experience space loss or spreading loss different from that of energy propagated along other rays. Space loss from the feed 12 to any point on the reflector is inversely proportional to the distance between the feed 12 and that point. Thus, energy propagated along an incident ray between feed 12 and reflector 14 which is longer than another such incident ray will experience greater space loss. Because space loss is associated with a spherical wave, energy following reflected rays between reflector 14 and quiet zone 18 suffers no space loss.

FIG. 2 illustrates that the same principles apply for the horizontal geometry of range 10. Thus, space loss for energy following incident rays PF and PD between feed 12 and points F and D on reflector 14, from which reflected rays illuminate the sides of the quiet zone, is greater than such loss for energy following ray PE.

Because the feed 12 is offset from the center of the area of reflector 14 used to produce quiet zone 18 vertically but not horizontally, differential space loss in the vertical plane varies more than differential space loss in the horizontal plane. This difference is readily illustrated by comparing FIGS. 1 and 2. FIG. 1 shows that the difference between the lengths of rays PB and PH connecting feed 12 and reflector 14 in the vertical plane is greater than the difference between the lengths of rays PD and PE connecting feed 12 and reflector 14 in the horizontal plane. Thus, amplitude taper caused by differential space loss is greater in the vertical plane than in the horizontal plane.

Differential space loss in the vertical plane is conventionally compensated for by designing a feed with an amplitude pattern which corresponds inversely with the differential space loss pattern and tilting the feed to illuminate the reflector so that the peak of the main beam is at the appropriate angle to compensate for the differential space loss. In most cases, such a feed pattern exhibits a broad main beam and low backlobes. A feed with such a pattern, tilted to the appropriate angle, will partially compensate for amplitude taper in the vertical quiet zone dimension caused by differential space loss while introducing minimal additional amplitude taper in the horizontal quiet zone dimension caused by feed pattern amplitude roll off.

Figure 7:
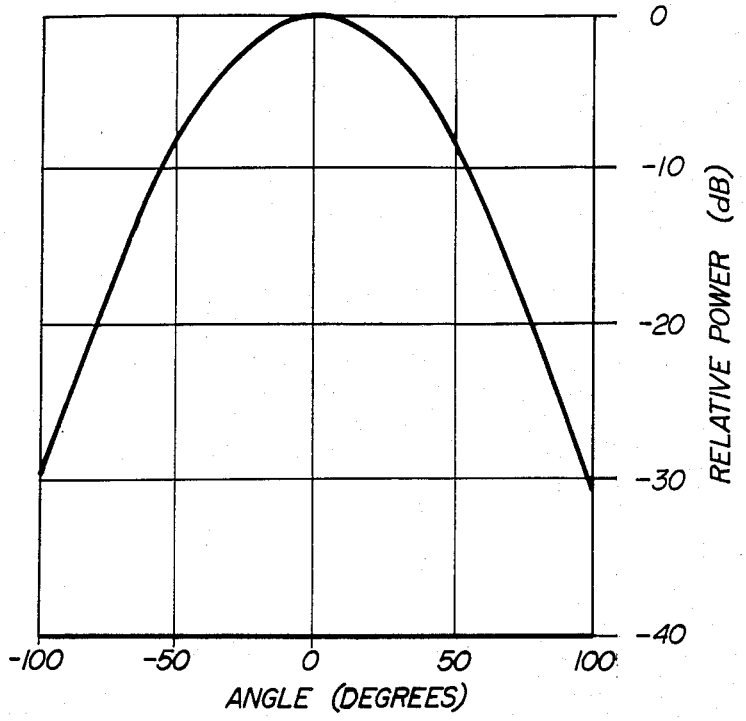
FIG. 7 is a graph showing a typical feed pattern for a standard feed taken at the center frequency of the half-octive band of operation.
Figure 6:
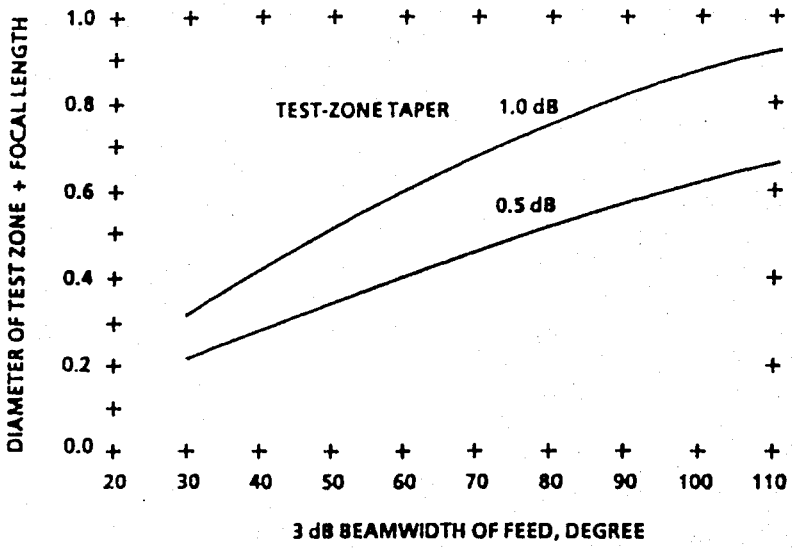
FIG. 6 is a graph showing compact range test zone taper as a function of feed beamwidth and the ratio of test zone diameter to reflector focal length.

R. C. Johnson, "Some Design Parameters for Point Source Compact Ranges," IEEE Transactions on Antennas and Propagation, vol. AP-34, no. 6, pp. 845-47, June 1986, which is incorporated by this reference, includes a graph which is reproduced herein as FIG. 6 showing curves for quiet zone taper as a function of feed beamwidth and the ratio of quiet zone size to reflector focal length The Johnson curves for 0.5-db test zone taper and 1.0db test zone taper are plotted as a function of 3db beamwidth of feed in degrees as the x-axis and the ratio of the diameter of the test zone to the focal length of the range as the y-axis. These curves are approximately linear between zero and ninety degrees feed beamwidth and, as expected, have a positive slope. They indicate as a general matter that a feed with a broader 3-db beamwidth produces a test volume with a larger diameter relative to the reflector focal length. Open ended circular waveguide radiators with diameters comparable to the largest dimension of a standard rectangular waveguide exhibit 3-db beamwidths on the order of fifty degrees. The Johnson curves as shown in FIG. 7 indicate that such feeds should produce a quiet zone or test volume diameter approximately equal to one-third of the focal length of the reflector for a test volume with a ½-db amplitude taper. This corresponds to the performance of previous compact range feeds.

A typical H-plane pattern for a standard open-ended round waveguide aperture feed with corrugated choke flange is shown in FIG. 7. This pattern corresponds to the center frequency of the half-octave band of operation for the feed. The beam is approximately azimuthally symmetric and the E-plane pattern is thus not shown. This pattern utilized with the reflector schematically shown in FIGS. 1 and 2 produces a quiet zone eight feet high by twelve feet wide with a 1-db amplitude taper.

R. C. Johnson, H. A. Ecker and J. H. Hollis, "Determination of Far-Field Antenna Patterns from Near-Field Measurements", Proceedings of the IEEE, vol. 61, no. 12, pp. 1668–94 (December, 1973) and W. D. Burnside and A. K. Dominek, "Blended Surface Concept for Compact Range Reflector," Proceedings of the Annual Meeting of the Antenna Measurement Techniques Association, pp. 10–1-10–10, Melbourne, Florida, October 29–31, 1985, which are both incorporated by this reference, disclose techniques for blended and rolled reflector edge treatments and other techniques to limit reflector edge defraction significantly and thus increase the size of the reflector surface area which could be used to produce the quiet zone. Such techniques accordingly allow for additional increase in the quiet zone size by increasing pattern beamwidth according to the present invention without encountering significant additional edge defraction on the reflector.

Unfortunately, increasing the beamwidth of the compact range feed also necessarily increases the level of direct feed radiation into the quiet zone. Although this phenomenon is referred to as backlobe radiation, the angle from the feed to the quiet zone is typically such that outer portions of the feed main beam actually radiate directly into the quiet zone. For the reflector shown in FIGS. 1 and 2, the front of the quiet zone (nearest the reflector) is approximately eight feet behind the feed. Depending upon the angle from horizontal at which the feed is tilted, which may be approximately 25°, the angle from the feed to the front top center point of the quiet zone is approximately 100°. At the high end of the band of operation of the standard feed, the feed pattern level at this angle is typically below −40-db relative to the peak of the main beam. At the low end of the band where the main beam pattern is broader, the pattern level at this angle is approximately −30-db. Thus, field quality in the test volume may be adversely effected by increased beamwidth from the feed.

Apertures operating close to cutoff exhibit higher VSWR than is often acceptable in far-field applications. This higher than usual VSWR is typically acceptable for compact range applications, however.

It is well known that a round waveguide exhibits a lower cutoff frequency which is inversely proportional to its radius. Electromagnetic energy below the cutoff frequency will not propagate in the waveguide. Conversely, for a specified lower frequency of operation (and therefore broader beam width) there is a minimum diameter for empty round waveguide which will propagate electromagnetic energy at this frequency.

The relationship between the aperture field distribution of an antenna and its far-field radiation pattern can be described by a Fourier transform. Thus, an aperture distribution which is smaller spatially results in a broader-beamed far-field pattern. A smaller open-ended round waveguide radiator will accordingly exhibit a broader far-field pattern than a larger one.

Figure 3:
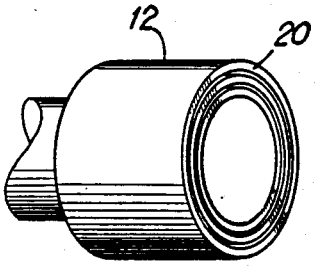
FIG. 3 is a schematic perspective view of a circular open ended waveguide feed according to the present invention with annular choke grooves.

According to one embodiment of the invention as shown in FIG. 3, an open-ended circular waveguide radiator is operated so that its lowest frequency of operation is between 0.8 and 3% above the cutoff frequency of the round waveguide itself to illuminate a compact range. The most preferable such operating frequency has been found to be approximately 1% above cutoff frequency. Because such a feed utilizes the minimum aperture area for a given lowest frequency of operation, it exhibits the maximum possible beamwidth for that frequency. This feed therefore produces the largest test volume possible with an open ended empty round waveguide feed for a given compact range reflector. By contrast, the lowest design frequency of operation for the standard feed is 1.35 times the cutoff frequency for the $TE_{11}$ mode.

The pattern of this circular open-ended empty round waveguide feed is frequency dependent and the band of operation is approximately a quarter-octave relative to the lowest frequency of operation, or approximately 1.25:1. A corrugated choke flange 20 as shown in FIG. 1 can be, but need not be, used to decrease the sensitivity of the pattern to frequency. Such a flange typically results in a slightly narrower beam width and consequently a smaller test volume.

This feed may also be used to radiate orthogonally polarized waves.

FIGS. 8A–C and 9A–C illustrate the performance of a standard feed, a circular open-ended empty round waveguide feed according to the configuration illustrated in FIG. 3 with choke slots operating at approximately 1% above cutoff frequency, and such a reduced-aperture feed without choke slots, respectively. FIG. 8 shows vertical field probe amplitude data and FIG. 9 shows horizontal field probe amplitude data for a single frequency. The reflector utilized was a Scientific-Atlanta model 5754 compact range reflector having a seven and one-half foot radius semicircular paraboloidal section with a two and one-half foot blended rolled edge treatment. Each of the feeds was arranged to illuminate the reflector to produce a six foot diameter quiet zone.

Figure 8A:
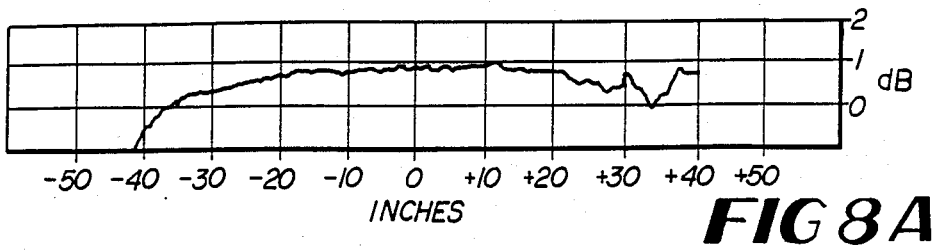
FIG. 8A is a graph showinq field probe amplitude as a function of vertical distance from the test zone center for a compact range fed by a standard feed.
Figure 8B:
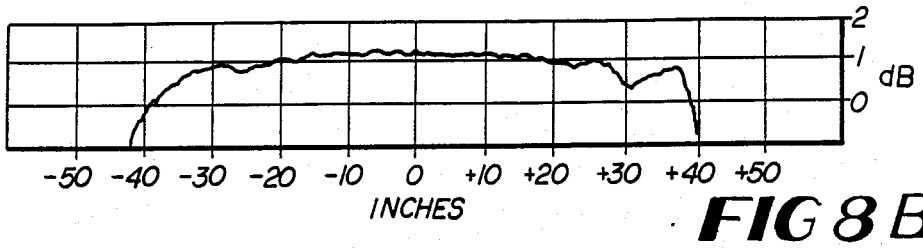
FIG. 8B is a graph showing field probe amplitude as a function of vertical distance from the test zone center for a compact range fed by a circular open-ended feed according to the present invention having a choke flange.
Figure 8C:
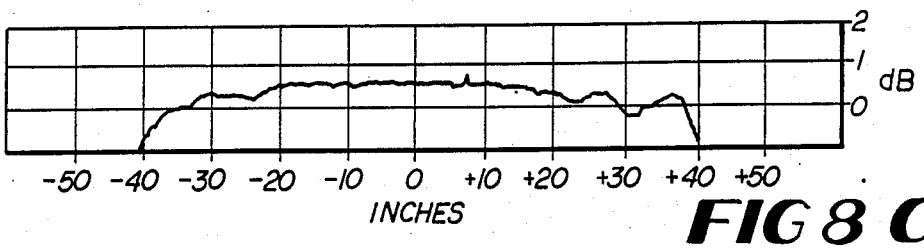
FIG. 8C is a graph showing field probe amplutide as a function of vertical distance from the test zone center for a compact range fed by a circular open ended feed according to the present invention without choke flange.

FIG. 8A shows that the amplitude taper across the six foot vertical quiet zone dimension is approximately 1-bb for the standard compact range feed. The reduced aperture feed with choke slots as shown in FIG. 8B, by contrast, produces an amplitude taper across the same six foot vertical quiet zone dimension of approximately 0.8-0.9db When the choke flange is removed as shown in FIG. 8C, the amplitude taper across the six foot quiet zone decreases to approximately 0.7db.

Figure 9A:
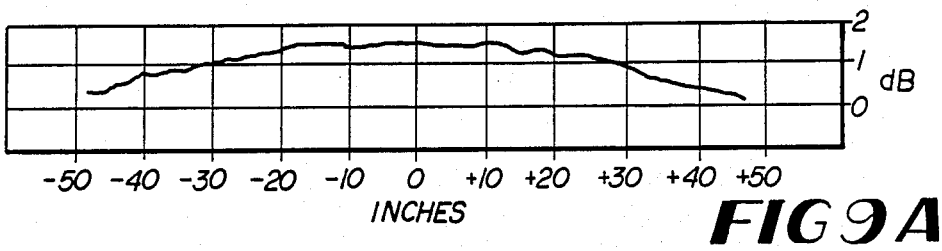
FIG. 9A is a graph showing field probe amplitude as a function of horizontal distance from the test zone center for the compact range fed by the feed of FIG. 8A.
Figure 9B:
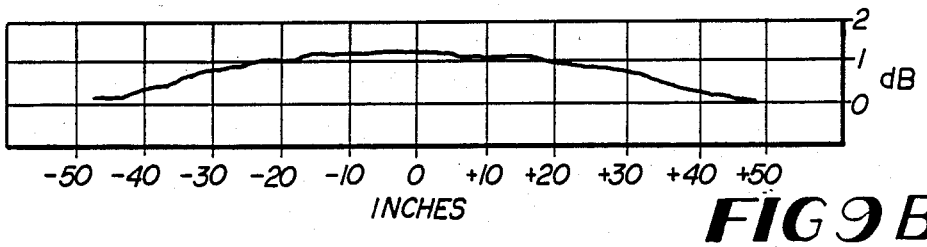
FIG. 9B is a graph showing field probe amplitude as a function of horizontal distance from the test zone center for the compact range fed by the feed of FIG. 8B.
Figure 9C:
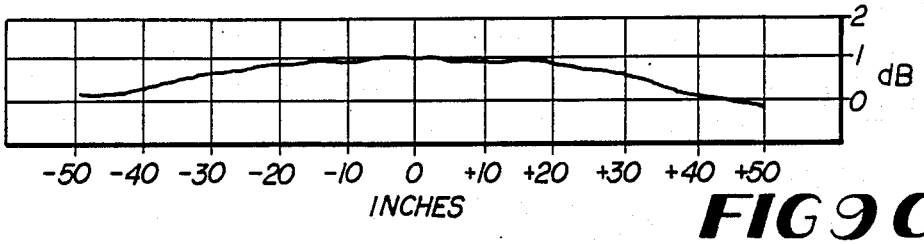
FIG. 9C is a graph showing field probe amplitude as a function of horizontal distance from the test zone center for the compact range fed by the feed of FIG. 8C.

FIG. 9A shows that a standard compact range feed produces approximately 1-db of amplitude taper across the six foot horizontal dimension of the quiet zone. The reduced aperture feed with choke flange as shown in FIG. 9B reduces the amplitude taper to approximately 0.8db and the reduced amplitude feed without choke flange as shown in FIG. 9C reduces the amplitude taper to approximately 0.5-0.6db in the horizontal quiet zone dimension.

Although the corrugated choke flange increases the amplitude taper, because it narrows the beam of the open-ended waveguide feed, pattern symmetry and stability with frequency suffer and the feed radiates more energy directly into the quiet zone in the absence of a corrugated choke flange. In some instances, amplitude ripple caused by such backlobe radiation may be a more important design consideration that reduction of amplitude taper and use of a corrugated choke flange may be indicated.

Figure 4:
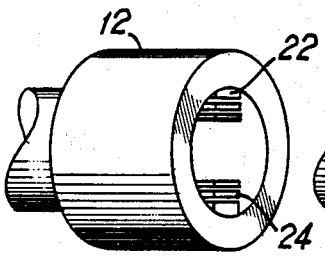
FIG. 4 is a schematic perspective view of a circular open ended waveguide feed according to the present invention loaded with a pair of slotted ridges oriented parallel to the E-plane of the propagated wave.

A second feed according to the present invention is shown in FIG. 4. This feed corresponds to the feed shown in FIG. 1 but is loaded with a single pair of axial ridges.

It is well known that the cutoff frequency of a round waveguide loaded with a pair of axial ridges is lower than the cutoff frequency for an empty round waveguide of the same diameter. Conversely, for a specified lowest frequency of operation, a ridge-loaded round waveguide radiator can be made to have an aperture smaller than the aperture of the smallest possible empty round waveguide radiator. Accordingly, for the reasons discussed above, such a configuration produces a broader beamwidth for a lowest frequency of operation than an empty round waveguide radiator able to operate at the same frequency.

The ridged waveguide feed is made by adding a pair of axial ridges to an empty round waveguide radiator, in the conventional manner that ridges have long been added to lower cutoff frequencies in waveguides. The diameter of the empty round waveguide is chosen so that the cutoff frequency of the empty round waveguide is approximately 25% higher than the desired lowest frequency of operation. The waveguide may be selected to have a larger or smaller aperture. The waveguide size is selected preferably to allow the cutoff frequency of the ridged waveguide feed to be well below the desired lowest frequency of operation.

FIGS. 10A-B and 11A-B show field probe data taken on a Scientific-Atlanta model 5754 compact range illuminated first by a standard feed and then by a ridged waveguide feed operating at the mid-band frequency of the standard feed. Choke slots 22 were placed in ridges 24 as shown in FIG. 4. The field probe data shown in FIG. 10 are taken vertically in a vertically polarized field and the data in FIG. 11 are taken horizontally in the field.

The ridged waveguide feed used for these measurements was operated in the X-band (8.2–12.4GHz). The round waveguide in which the ridge was constructed, however, was of the same diameter as the standard Ku-band (12.4–18GHz) compact range feed. The ridges capacitively load the fundamental $TE_{11}$ mode and lower the cutoff frequency of the mode.

Figure 10A:
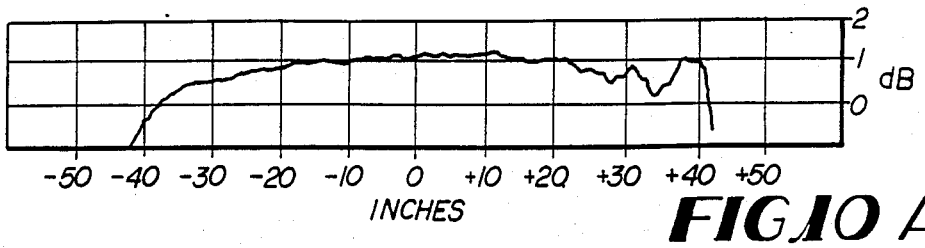
FIG. 10A is a graph showing field probe amplitude as a function of vertical distance from the test zone center for a compact range fed by a standard feed.
Figure 10B:
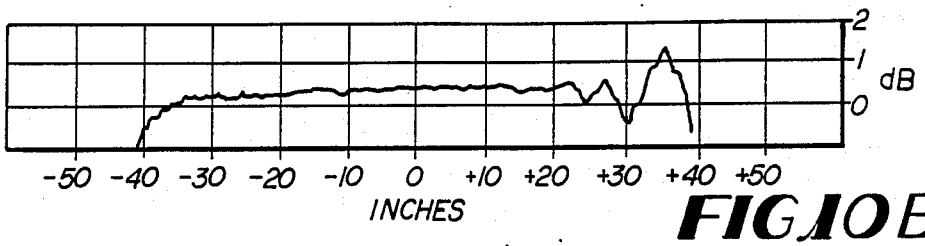
FIG. 10B is a graph showing field probe amplitude as a function of vertical distance from the test zone center for a compact range fed by the feed of FIG. 10A which has been loaded with a pair of axial ridges.
Figure 11A:
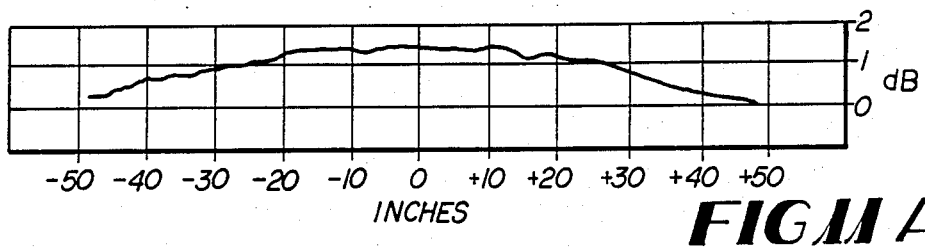
FIG. 11A is a graph showing field probe amplitude as a function of horizontal distance from the test zone center for the compact range fed by the feed of FIG. 10A.
Figure 11B:
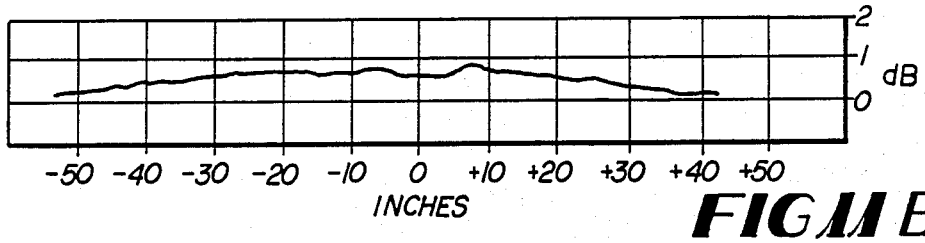
FIG. 11B is a graph showing field probe amplitude as a function of horizontal distance from the test zone center for the compact range fed by the feed of FIG. 10B.

The field probe data shown in FIG. 10 demonstrate the dramatic effect on amplitude taper in the quiet zone achieved with the ridged waveguide of FIG. 4. The standard compact range feed as shown in FIG. 10A produces approximately a 1-db taper across the six foot vertical quiet zone dimension. The ridged waveguide feed, by contrast, as shown in FIG. 10B, produces less than 0.5db taper across the same quiet zone dimension. In the horizontal quiet zone dimension as shown in FIG. 11A, the standard feed again produces approximately 1-db taper. The ridged waveguide feed as shown in FIG. 11B produces an approximately 0.5db taper across the same dimension.

As with the empty round waveguide feed, the pattern of the ridged waveguide feed is frequency dependent. Because the diameter of the waveguide is extremely small relative to the wave length at the operating frequency band, however, the ridged waveguide feed exhibits a broad beamwidth over a half-octave bandwidth relative to the lowest frequency of operation, or approximately 1.5:1. Again, a corrugated choke flange may be added to the feed in order to reduce the frequency dependence of the pattern at possible cost of reduced feed beamwidth. Chokes can be, but need not be, added as shown in ridges 24 to reduce the frequency dependence and improve the symmetry of the radiation pattern.

If the $TE_{11}$ mode is properly excited in the ridged waveguide feed so that asymmetrical higher order modes are not excited, the bandwidth of the ridged waveguide feed is potentially greater than that of the open-ended empty round waveguide feed. For the ridged waveguide feed used in the measurements mentioned above, the cutoff frequency of the next higher order mode with the same symmetry as the $TE_{11}$ mode was computed to be approximately 16GHz, indicating that the ridged waveguide feed could possibly be used to illuminate the reflector not only in the X-band but over much of the Ku-band as well. Such frequency coverage requires extremely precise fabrication techniques to avoid asymmetries which could excite undesired higher order modes at higher frequencies in the band.

The ripples shown in FIGS. 10A and 10B are caused by backlobe radiation into the quiet zone. The same probe horn was used to generate the data shown in both of those figures so that ripple magnitudes could be compared directly. The increase in the extraneous signal level due to backlobe radiation may be computed according to the following equation:

$$20 \log_{10} \frac{E_{ex}}{E_{pr}} = 20 \log_{10} \left( \frac{1 - 10^{-\Delta/20}}{2} \right)$$

Where $E_{ex}$ = extraneous signal level $E_{pr}$ = primary signal level and $\Delta$ = peak to peak amplitude ripple in db. This equation does not take into account the effect of the probe horn pattern, but the effect is the same for both feeds, and the probe horn pattern cancels out when only difference in level is considered. The computed difference in backlobe radiation amplitude into the quiet zone between the ridged waveguide feed and the standard feed is approximately 6db. That is, the amplitude of the direct feed radiation into the quiet zone compared to the amplitude of the collimated wave from the reflector is approximately 6db higher for the ridged waveguide feed than for the standard feed. The absolute levels (not taking into account the effect of the probe horn pattern) are on the order of −40db.

Figure 5:
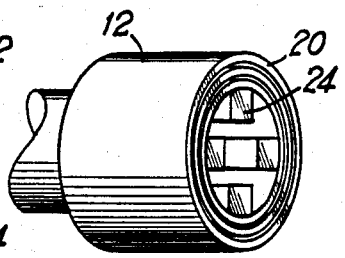
FIG. 5 is a schematic perspective view of a circular open ended waveguide according to the present invention loaded with two orthogonally oriented pairs of ridges.

A round waveguide radiator which may be used for a dual-polarized compact range feed is shown in FIG. 5. Such a feed may be constructed with a corrugated choke flange 20 as shown or without it and ridges 24 may or may not include choke slots 22.

This description is provided for illustration and description of preferred embodiments of the invention. Modifications and adaptations to these embodiments will be apparent to those of ordinary skill in the art and may be made without departing from the scope or spirit of the invention.

We claim:

1. A method of illuminating a compact range with energy in a predetermined bandwidth using a waveguide feed, comprising the steps of:

(a) selecting the bandwidth of energy for operation of the range, the bandwidth having a lowest frequency of operation $f_o$;

(b) selecting an open-ended non-ridged round waveguide feed whose radius defines a cutoff frequency $f_c$ in the $TE_{11}$ mode of substantially $f_o/1.008$;

(c) installing the feed on the range; and (d) supplying the feed with energy whose frequency is between $f_o$ and $1.26f_c$.

2. The method of claim 1 further comprising the step of adding a corrugated choke flange to the feed.

3. A method of illuminating a compact rang with energy in a predetermined bandwidth using a waveguide feed, comprising the steps of:

(a) selecting the bandwidth of energy for operation of the range, the bandwidth having a lowest frequency of operation $f_o$;

(b) selecting an open-ended round waveguide feed whose radius defines a cutoff frequency in the $TE_{11}$ mode of substantially $1.25f_o$;

(c) loading the waveguide feed with two ridges oriented parallel to its length;

(d) installing the feed on the range; and (e) supplying the feed with energy whose frequency is between $f_o$ and $1.5f_o$.

4. The method of claim 3 further comprising the step of adding a corrugated choke flange to the feed.

5. The method of claim 3 further comprising the step of adding a plurality of choke slots in each ridge.

6. A method of illuminating a compact range with energy in a predetermined bandwidth using a waveguide feed, comprising the steps of:

(a) selecting a bandwidth of energy for operation of the range, the bandwidth having a lowest frequency of operation $f_o$;

(b) selecting an open-ended round waveguide feed whose radius defines a cutoff frequency in the $TE_{11}$ mode of substantially $1.25f_o$;

(c) loading the waveguide feed with two pairs of ridges, each pair oriented orthogonally to the other pair and parallel to the feed's length;

(d) installing the feed on the range; and (e) supplying the feed with energy whose frequency is between $f_o$ and $1.5f_o$.

7. The method of claim 6 further comprising the step of adding a feed having a corrugated choke flange to the feed.

8. The method of claim 6 further comprising the step of adding a plurality of choke slots in each ridge.

* * * * *